US008746860B2

(12) United States Patent
Delueg

(10) Patent No.: US 8,746,860 B2
(45) Date of Patent: Jun. 10, 2014

(54) INK SUPPLY SYSTEM AND PROCESS FOR CLEANING THIS TYPE OF INK SUPPLY SYSTEM

(71) Applicant: Durst Phototechnik Digital Technology GmbH, Lienz (AT)

(72) Inventor: Verner Delueg, Brixen (IT)

(73) Assignee: Durst Phototechnik Digital Technology GmbH, Lienz (AT)

( * ) Notice: Subject to any disclaimer, the term of this patent is extended or adjusted under 35 U.S.C. 154(b) by 0 days.

(21) Appl. No.: 13/941,596

(22) Filed: Jul. 15, 2013

(65) Prior Publication Data

US 2013/0300807 A1 Nov. 14, 2013

Related U.S. Application Data

(62) Division of application No. 12/462,930, filed on Aug. 11, 2009, now abandoned.

(30) Foreign Application Priority Data

Aug. 14, 2008 (AT) ..... A 1275/2008

(51) Int. Cl.

| | |
|---|---|
| ***B41J 2/175*** | (2006.01) |
| ***B41J 29/38*** | (2006.01) |
| ***B41J 2/17*** | (2006.01) |
| ***B41J 2/18*** | (2006.01) |
| ***B41J 2/19*** | (2006.01) |

(52) U.S. Cl.

CPC ..... *B41J 2/175* (2013.01); *B41J 2/17556* (2013.01); *B41J 2/18* (2013.01); *B41J 2/19* (2013.01)

USPC ..... 347/85; 347/17; 347/84; 347/89; 347/92; 347/93

(58) Field of Classification Search

CPC ..... B41J 2/175; B41J 2/17596; B41J 2/18; B41J 2/19; B41J 2/17556

USPC ..... 347/7, 17, 84, 85, 89, 92, 93

See application file for complete search history.

(56) References Cited

U.S. PATENT DOCUMENTS

| | | | |
|---|---|---|---|
| 4,929,963 | A | 5/1990 | Balazar |
| 5,801,736 | A | 9/1998 | Ikkatai et al. |

(Continued)

FOREIGN PATENT DOCUMENTS

| | | | |
|---|---|---|---|
| DE | 600 08 084 | T2 | 12/2004 |
| EP | 0 714 778 | A1 | 6/1996 |

(Continued)

OTHER PUBLICATIONS

Austrian Office Action dated Jun. 3, 2009 in Austrian Application No. A 1275/2008 along with an English translation of the relevant parts.

*Primary Examiner* — Charlie Peng
*Assistant Examiner* — Hung Lam
(74) *Attorney, Agent, or Firm* — Collard & Roe, P.C.

(57) ABSTRACT

An ink supply system includes a print head assembly and a print head with one or more nozzles for a color. The print head is connected with the nozzles via a first connection line. A supply tank is connected with an intermediate tank via a filler line under an interconnection of a feed unit and a filter assembly. The pressure difference of the ink flow from a return tank to the supply tank is controlled by the print head. A method cleans the ink supply system, and a method cleans the print head.

6 Claims, 3 Drawing Sheets

(56) References Cited

U.S. PATENT DOCUMENTS

| | | | | |
|---|---|---|---|---|
| 6,007,193 | A | 12/1999 | Kashimura et al. | |
| 6,231,174 | B1 | 5/2001 | Haigo | |
| 6,371,607 | B2 | 4/2002 | Wouters et al. | |
| 7,841,708 | B2 | 11/2010 | Morgan et al. | |
| 8,128,196 | B2 | 3/2012 | Garbacz et al. | |
| 2006/0132554 | A1 * | 6/2006 | Ota et al. | 347/85 |
| 2008/0024553 | A1 | 1/2008 | Morgan et al. | |
| 2008/0273063 | A1 | 11/2008 | Wouters et al. | |
| 2008/0297577 | A1 | 12/2008 | Wouters et al. | |
| 2009/0040249 | A1 * | 2/2009 | Wouters et al. | 347/7 |

FOREIGN PATENT DOCUMENTS

| | | | |
|---|---|---|---|
| EP | 1 361 066 | A1 | 11/2003 |
| EP | 1 831 025 | B1 | 5/2008 |
| WO | WO 2008/108245 | A1 | 9/2008 |

* cited by examiner

INK SUPPLY SYSTEM AND PROCESS FOR CLEANING THIS TYPE OF INK SUPPLY SYSTEM

CROSS REFERENCE TO RELATED APPLICATIONS

This application is a divisional of and Applicant claims priority under 35 U.S.C. §§120 and 121 of U.S. application Ser. No. 12/462,930 filed on Aug. 11, 2009, which claims priority under 35 U.S.C. §119 from Austrian Patent Application No. A 1275/2008 filed on Aug. 14, 2008, the disclosures of each of which are hereby incorporated by reference. A certified copy of priority Austrian Patent Application No. A 1275/2008 is contained in parent U.S. application Ser. No. 12/462,930.

BACKGROUND OF THE INVENTION

1. Field of the Invention

The invention relates to an ink supply system as well as to a process for cleaning this type of ink supply system.

2. The Prior Art

Ink supply systems already exist for inkjet printers, which have a print head assembly with at least one print head. As per EP 1 831 025 B1, this form of system comprises a supply tank which contains an ink reservoir for an inkjet print head and a return tank which has an overflow for ink unused by the inkjet print head. An intermediate container, which contains a larger reservoir of ink is connected with the supply tank via a line with interconnected filter assembly. Depending on the level of ink in the supply tank, a means of conveyance transports ink from the intermediate container into the supply tank. From the supply tank, the ink is fed via a supply line through the first connection line of a flow channel in a print head, whereby the second connection line for this flow channel is connected with the return tank via an additional connection line, which is linked with the intermediate container by means of an additional connection line with interconnected filter assembly and means of conveyance. During printing, a means such as a vacuum generator generates an internal differential pressure between the inside of the supply tank and the inside of the return tank, such that this pressure differential transports the ink from the supply tank through the print head to the return tank. In addition to supplying the ink to the print head or print heads, it is also already known that the print head is flushed through with this form of inkjet printing system, in order to remove any impurities. In order to do so a positive pressure is generated in the supply tank and the return tank, which ensures that the ink contained in the two tanks is flushed through the print head. The disadvantage of this system is that flushing the ink through the fine drilled holes in the individual inkjet nozzles of the inkjet print head forces the deposited impurities in the system through the fine nozzles apertures of the individual print head nozzles and can block these.

SUMMARY OF THE INVENTION

The invention is based on the objective of designing an inkjet supply system in which the ink can be constantly routed in a circuit, and which facilitates the discharge from the circuit of any impurities present in it with minimal effort.

This objective is solved by an ink supply system having the characteristics according to one aspect of the invention. Advantageous with this ink supply system is that fine control and constant maintenance of pressure in the print head can be achieved during printing. Due to the configuration of the individual components, it is possible to clean the return and supply tanks, the lines and the flow channels in the print head or print heads with very minimal addition effort and without any loss of ink by suctioning the inside of the print head or print heads. This additionally avoids the displacement of the fine nozzle drill holes in the print heads. A further added advantage is achieved in the print head or print heads due to perfusion through the lines, the tanks and the flow channels because residue deposited or adhered in the main flow direction can be better lifted and loosened from the walls by a counter-directional flow.

Due to a further development, with the return conveyance of the ink from the return tank via the print head into the supply tank it is possible for any ink to be pumped directly back into the intermediate tank, in order to mix here with ink already in circulation or new ink, before being re-supplied to the ink supply circuit via the appropriately designed filter.

Also advantageous is a design variant, with which the excess ink can be precisely drained from the return tank.

With other embodiments, the pressure equalization in the ink between the levels in the supply and return tank can be precisely controlled proportionate to the nozzle drill holes in the print head and an undesirable dripping of the ink thus avoided even with fluctuating fluid levels in the supply and return tanks, for example when filling or pumping off the ink. Furthermore, when halting the printer or where there is a pause in printing, a sufficient ink pressure retention can be achieved in the vicinity of the nozzle drill holes in the print heads. Also advantageous in this regard is the design of the pressure controller as per another embodiment.

With a further design variant, it is very simple to maintain constant pressures in the ink in the vicinity of the print head. Whereby it is possible to develop an advantageous means with which to maintain a pressure differential as per another embodiment.

With another development, it is possible to fully empty the return tank and thus to also ensure that it is possible to vacuum off the impurities found at the bottom. Furthermore, a further embodiment is advantageous because it is possible to guarantee the complete emptying of the intermediate tank in this way.

Another embodiment is advantageous because it is also possible to fully empty the supply tank within the framework of the cleaning process.

A simplified charging of the supply and return tank with pressurising medium is achieved through a further development.

However, the present objective is also independently achieved through a process of cleaning an ink supply system according to another aspect of the invention. Advantageous hereby is that it is possible to remove impurities such as those which accumulate through sedimentation, by means of a form of self-cleaning system with the circulating ink. It is therefore possible to shorten interruptions and cleaning procedures can also be carried out during advantageously shortened intervals. Furthermore, no additional cleaning fluid is required for this cleaning process and the length of interruption required for the cleaning cycle is thus considerably reduced. Additionally, due to the omission of an additional cleaning fluid the subsequent printing process cannot be adversely influenced At the same time, due to the reversal of the flow direction this process results in an improved dislodging of residue and impurities from the line walls and in the individual tanks, as well as any sedimentation adhered to the walls and any air bubbles. Due to the reversal of the flow direction of the ink against the flow direction during printing, the entire print head and supply tank is flushed through and emptied during the cleaning process, meaning that all of the residue and sedimentation is definitively directed away.

Advantageous is a further method because the ink, whilst being conveyed back from the return tank via the supply tank to the intermediate tank, flows freshly across the bottom area of the supply tank where it is able to better sweep away the contaminants there.

Due to a process variant, it is possible to suction off the impurities, in particular from the border areas of the nozzle drill holes in the print head, and to thus considerably reduce the build-up of a layer as well as the risk of displacing the fine nozzles.

Due to an alternative method it is possible to additionally increase the flow speed of the ink through the supply tank, so that any impurities found there are more successfully removed.

Due to a process variant it is possible to achieve an extremely even ink quality throughout the complete printing process.

An improved cleaning effect is achieved for example through the method as per another embodiment because the additional flow of fresh ink from the intermediate tank via the filter is prohibited whilst cleaning the supply tank.

BRIEF DESCRIPTION OF THE DRAWINGS

In order to facilitate a better understand the invention, this is more clearly explained by means of the following figures.

The heavily simplified schematics show.

DETAILED DESCRIPTION OF PREFERRED EMBODIMENTS

It must first be stated that in the various embodiments described, identical parts have been marked with the same reference identifiers and the same parts descriptions. It is therefore possible to transfer the disclosures contained in the overall description to the identical parts with the same reference identifiers or the same parts descriptions. The selected positioning terms are used in the description, such as top, bottom, side etc, which refer directly to the described and the depicted figures and which can be correspondingly transferred to the new position in the event of a change in position. Furthermore, individual characteristics or combinations of characteristics from the various embodiments shown and described can present independent or inventive solutions, or solutions according to the present invention. All value range specifications in the objective description should be taken as arbitrary ranges which encompass all subareas lying within these ranges, e.g. the specification 1 to 10 should be understood to encompass the full range starting from the bottom limit 1 and rising to the top limit 10, i.e. all subareas start with a bottom limit of 1 or more and end with a top limit of 10 or less, e.g. 1 to 1.7, or 3.2 to 8.1, or 5.5 to 10.

Figure 1:
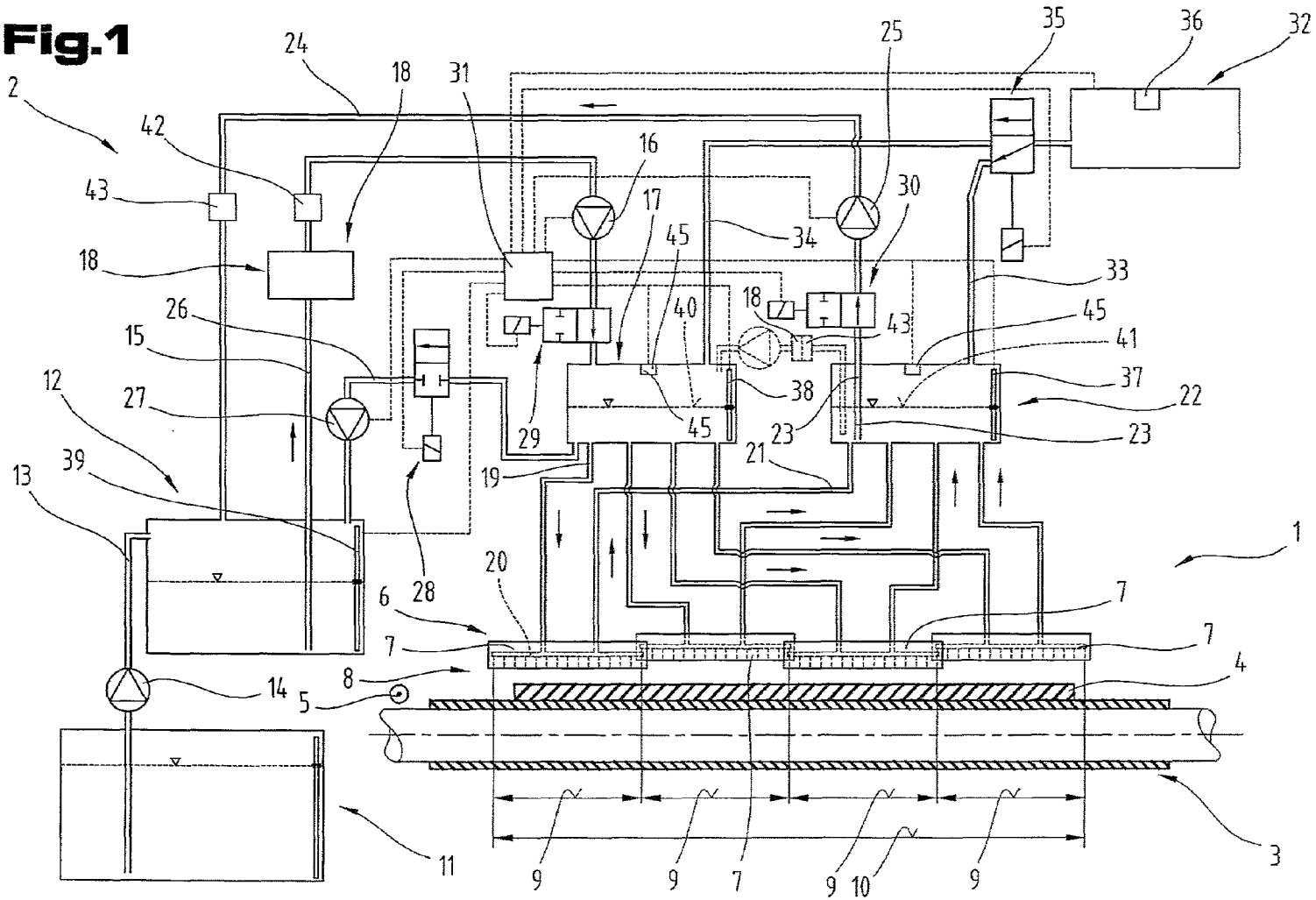
FIG. 1 shows an inkjet printing device with an ink supply system in a heavily simplified schematic diagram, in the operating mode "printing"

FIG. 1 shows a section of an inkjet printer 1 with an ink supply system 2 in a heavily simplified schematic diagram. For reasons of enhanced clarity, the ink supply system 2 has only been shown for one color or one ink. If an inkjet printer 1 is required to print multi-colored images, a sufficient number of ink supply systems 2 will be required in order to print the number of colors required for the respective image.

The inkjet printer 1 exhibits a horizontally arranged feed device 3 for feeding a printable object 4, which may be lying upon it and secured against sliding, in a feed direction 5 (as per the diagram vertically upward from the plane of projection). A print head assembly 6 is located above the feed device 3, with print heads 7 which print the printable object 4 with ink as it passes beneath them.

It is necessary to state that the ink supply system 2 can also be used for single pass printing systems in which the print heads do not move. Furthermore, with a feed device 3 it is thus possible to fully print a printable object 4 across the complete, maximum printing width with the required colors and, if required with the color WHITE, a transparent color layer and/or protective layer. Naturally the ink supply system 2 can also be used with scanner print heads, with which multiple print heads can be attached for different colors as well as the color WHITE where applicable and/or transparent and/or protective layers, whereby the print head(s) only span a part of the width of the printable object 4 and in which case the colors are applied in stripes during a lateral motion to the longitudinal positioning of the object 4, and the printable object 4 is moved intermittently forwards by the feed device 3 which is set to move a specific distance in the direction of conveyance after every lateral motion of the print head across its width. Furthermore, it is also possible to use the ink supply system 2 for printers in which the ink droplets are directed by an electromagnetic field after exiting the print head, such that they arrive in the correct position on the printable object. With respect to the printable object 4, this can be a range of materials such as sheet-type materials from paper, plastic, metal, textile and similar as well as fleece, net and similar, or it may also be board-type material or tape-type material produced from the aforementioned materials. It is possible in particular to print board-type material or parts from sheets of wood, for example also with woods exhibiting various wood structures, ceramics such as ceramic parts from fired wares or green parts, natural stone or other natural materials such as mat, net, fleece or leather and other construction materials such as gypsum plasterboard, gypsum parts or similar.

The feed device 3 is formed for example from a constant conveyor belt which is fed or driven by at least two feed rollers. The top section of the conveyor belt, which moves in the feed direction 5, is supported in this by one or more guide plates on its underside, so that an appropriate even horizontal movement of object 4 is achieved in the feed direction 5. It is naturally also possible to employ a moveable sled in place of a conveyor belt, on which the printable object 4 is held by means of a vacuum or a fixing device, or to move the printable object 4 on a roller conveyor or between guide rollers beneath the print head assembly 6. In the previous embodiment, the print head assembly 6 exhibits multiple print heads 7 for each color, so that entire width of the print media or the object 4 can be printed at one time, without the print head assembly 6 having to move in a lateral direction relative to the feed direction. I.e. the print head assembly 6 is laterally fixed during the printing or is stationary with respect to the feed device 3.

Each of the print heads 7 exhibits a row of nozzles formed by a number of nozzles 8 located adjacent to one another and configured in the standard linear formation. With print heads 7, as customarily used in so-called large format printing, usually on the basis of piezoelectric ink jets, the nozzle row contains e.g. 128 nozzles 8 adjacent to one another (for reasons of clarity, only shown schematically in FIG. 1) which are shown with a slashed line. A single print head 7 or one row of nozzles thus exhibits a perpendicular print width 9 with respect to the feed direction 5. The print heads 7 or their print nozzles are configured in rows, tightly adjacent to one another so that the print head assembly encompasses a complete print area width 10. In order that the print width 9 of the nozzle rows 8 can be lined up without clearance, the print heads 7 must be arranged in an alternating offset configuration with respect to the feed direction 5. This is additionally shown in the schematic per FIG. 1 with a slight vertical offset. The print heads 7 could be arranged diagonally to the feed direction 5 instead of perpendicular, whereby this results in a smaller print width 9 although a higher resolution or density of pixels.

The ink supply system 2 comprises a main tank 11, from which an intermediate tank 12 is supplied with ink. These are connected via a supply tank 13, in which a conveyance means 14 is installed. In order to supply the print heads 7 from the intermediate tank 12 with ink, this is connected with the print head assembly 6 or the print heads 7 via a filler line 15. Thus, multiple print heads 7 are each connected with the common intermediate tank 12 via a line. It can be advantageous here that all of the filler lines 15 connecting the intermediate tank 12 with the print heads 7 exhibit a straight decline from the intermediate tank 12 to the print heads 7. This has the advantage that air bubbles, which can appear in the transported ink for a range of reasons, are always able to pass upwards, thereby minimising the number of possible malfunctions of a print head 7.

A means of conveyance 16 is located in the filler line 15, with which the ink is transported out of the intermediate tank 12 through the filler line 15 to a supply tank 17 located between this and the print heads 7. In order to remove any impurities, such as sedimentation or agglomerations in the ink, a filter assembly 18 is located in the filler line 15 between the intermediate tank 12 and the supply tank 17. The supply tank 17 is connected with an inlet to a flow channel 20 in the print head 7, by way of a first connection line 19. A second connection line 21 is connected with the end of the flow channel 20 opposite the first connection line. This connects the flow channel 20 with the return tank 22.

A suction line 23 is located in this return tank 22. It is connected with a return line 24 which discharges into the intermediate tank 12. In order to convey excess ink from the return tank 22 into the intermediate tank 12, a means of conveyance 25, for example a piston pump or vane pump, is installed. Additionally, a drainage line 26 is installed between the supply tank 17 and the intermediate tank 12. This is preferably fitted in the vicinity of the bottom of the supply tank 17.

It is also advantageous if the first connection line is connected between the supply tank 17 and the print head 7 in the vicinity of the bottom of the supply tank 17.

It is possible and preferable for a means of conveyance 27, for example a pump, to be installed in the drainage line 26. It is however also possible for the drainage line 26 to be activated if necessary by a valve assembly 28, whereby the line connection between the supply tank 17 and the intermediate tank 12 is opened whilst being preferably closed in standard printing mode.

It is also possible in this regard to install valve assemblies 29 and 30 in the filler line 15 and in the return line 24. It is thereby also possible to open these lines or close them as necessary. All valve assemblies are preferably fluidic valves, which are preferably adjustable to the respective operating statuses by way of electromechanical drives dependent on control commands from a central controller 31. Manual adjustment of these valve assemblies is naturally also possible, for example by means of an emergency button or manual button. The return tank 22 at least, and preferably also the supply tank 17, shall be connected at least alternately with a means 32, in particular a vacuum module, for controlling the counter-pressure on the print head 7. By way of this means 32, in particular a vacuum module which can comprise a vacuum pump or a venturi nozzle assembly, it is possible to generate a counter-pressure to the hydrostatic pressure of the ink in the vicinity of the nozzles 8 of the print head 7 in the supply and/or return tank 17, 22.

In order to achieve this, the return tank 22 at least and preferably also the supply tank 17 must be connected to the means 32 or the vacuum generation system by pressure connections 33, 34. It is preferable and possible that a central vacuum generation system or vacuum pump is available and that this is alternately connected via the pressure connection exclusively with the return tank 22 or exclusively with the supply tank 17, for which purpose a valve assembly 35 is planned, which may be the same as the aforementioned valve assembly 28, 29. The means 32 for controlling the counter-pressure also comprises active pressure controller 36. This is connected directly or via the controller 31 with the sensor assemblies 37 and/or 38 and/or 39 in the return and/or supply and/or intermediate tank 22, 17, 12. They predominantly serve to determine the fluid levels in the individual tanks and can also control the conveyance means 16 and 25 via the controller 31.

The means 32 with which to maintain a differential pressure, e.g. the vacuum system, is designed such that the necessary differential pressure is generated for the ink flow and the pressure loss caused by the hydrostatic pressure in the fluid columns is balanced, so that the absolute pressure of the fluid columns in the vicinity of the nozzle apertures 8 of the print heads is less than the ambient air pressure. The supply and/or return tanks 17, 22 are connected with the vacuum system such that the air above the fluid level of the fluids 40, 41 ink can be placed under negative pressure relative to the ambient air pressure. This is necessary in order to prevent a leaking of the filled inks through the nozzle apertures in the print heads 7 due to the inherent weight of the inks. Furthermore, sensor devices 37, 38 are installed in the supply and/or return tank 17, 22 for level monitoring; these can be used to measure the fluid levels 40, 41 of the ink. With the aid of the sensor device(s) 37, 38 it is possible to monitor the fluid levels 40, 41 in the tanks by means of the controller 31, and to refill to/from the intermediate tank 12 by actuating the conveyance means 16, so that the fluid level 40, 41 can be held at a preferable constant level.

It is important to keep the level of the fluid as constant as possible because the hydrostatic pressure of the ink, corresponding to the difference between the levels of the fluids 40, 41 and the nozzle apertures of the nozzles 8 in the print heads 7, is co-responsible for the pressure relationships between the inks in the print heads 7 and thus for fault-free running. In a stationary instance, where no ink is discharged from the nozzles 8 of the print heads 7 and the ink is only circulating in a circuit between the intermediate tank 12, the supply tank 17, the return tank 22 and the intermediate tank 12, the sum of the air pressure in the tanks 17, 22 and the hydrostatic pressure of the ink fluid is equal or less than the ambient air pressure. When in an operating mode, in which the nozzles 8 of the print heads 7 discharge ink, there is a reducing pressure loss in the fluid pressure of the ink in the print heads 7 due to the flow resistance which results from the ink flowing into the lines. The air pressure generated above the fluid levels 40, 41 in the tank or tanks 17, 22 by the means 32, should thus be set such that the fluid pressure of the ink in the print heads 7 lies within the pressure tolerance range required for faultless print head operation in every operating mode between standstill and maximum ink discharge.

In very general terms, the negative pressure or the air pressure above the fluid levels 40, 41 must be set such that both the differential pressure necessary for the ink flow and the correct meniscus negative pressure at the nozzle apertures is achieved.

Figure 2:
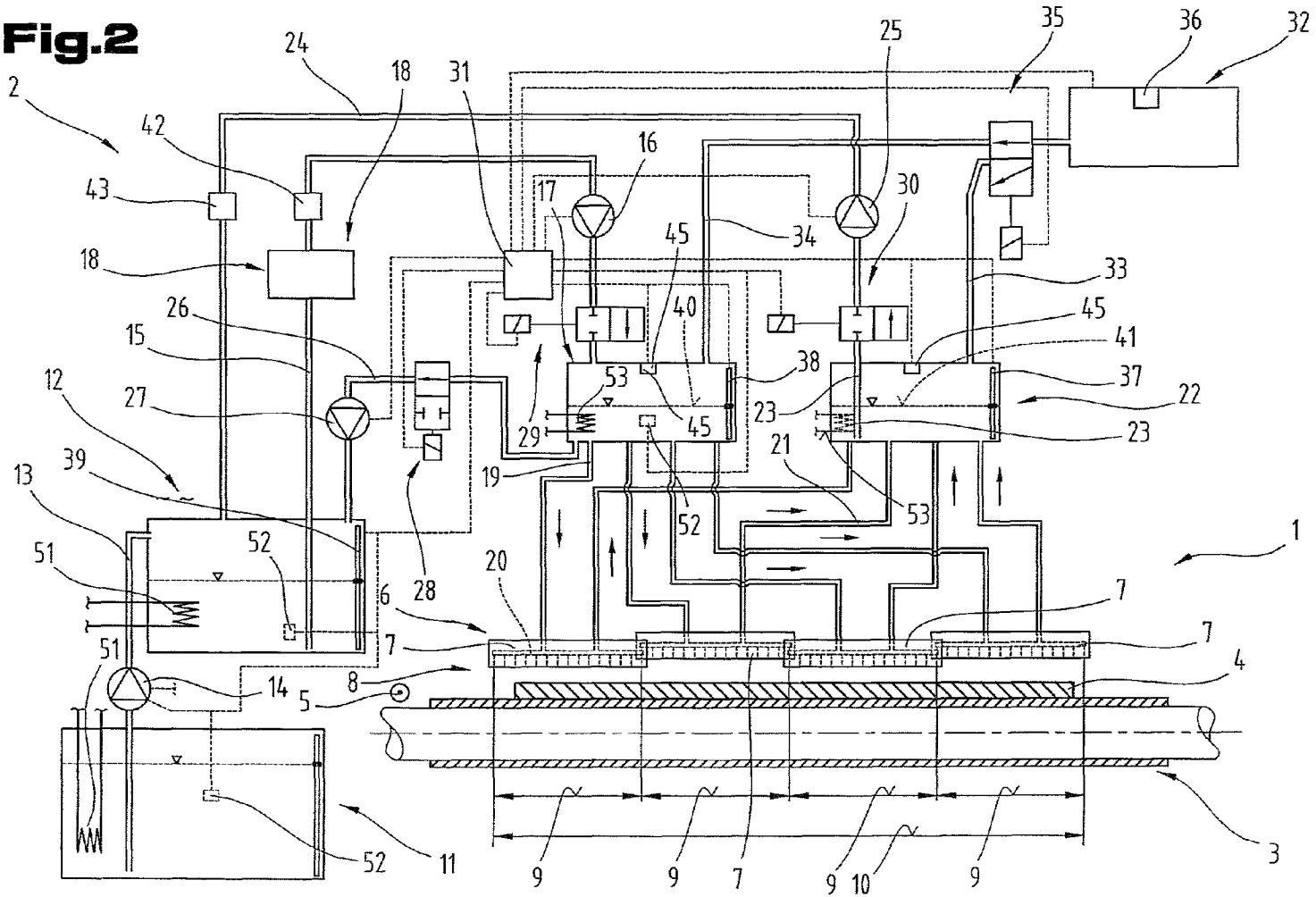
FIG. 2 shows the ink supply system as per FIG. 1 in the operating mode "cleaning" in a heavily simplified schematic diagram.

The schematic in FIG. 2 reflects the schematic in FIG. 1, whereby identical reference identifiers have been used for identical parts.

The process sequence when operating the inkjet printer 1 is now as follows:

The ink is suctioned from the intermediate tank 12 via a filler line 15 intake by a conveyance means 16, for example a supply pump from the intermediate tank 12 and cleaned, for example by a filter assembly 18 between the intermediate tank 12 and the conveyance means 16 and if necessary additionally degassed by a degassing unit 42, before being fed into the supply tank 17 after passing through—in this instance—an open valve assembly 29. The fill level 40 of the ink is monitored in the supply tank 17 by a sensor or sensor assembly 38. The means 32 of controlling the pressure ratios in the supply tank 17 or the return tank 22 forces the ink, e.g. by generating a negative pressure inside the return tank 22 with an appropriate setting of the valve assembly 35 as shown in FIG. 1, through the first connection lines 19, each independently, of the flow channels 20 into the respective parallel connected print heads 7, from which the ink is pressurised, e.g. by means of piezo elements or any other pressure generator accepted as being modern engineering practice, and discharged in the form of ink droplets from the nozzles 8 of the print heads 7, point-by-point onto the object 4.

Irrespective of the number of ink droplets dispensed by a print head 7 per time unit, the flow of the ink caused by the negative pressure in the return tank 22 is forced through the second connection line 21 and into the return tank 22. If a predetermined level 41 is exceeded here then the excess ink is fed back via a suction line 23 to return line 24 and from here, if necessary via a degassing unit 43, to the intermediate tank 12.

For the purpose of this enforced return of the excess ink from the return tank 22, a conveyance means 25, for example a pump, can also be controlled by the central controller 31 dependent on the level 41, which can be monitored with one or more sensor devices 37. During the printing process, the flow of ink is inhibited by the drainage line 26. This can take place either by halting the conveyance means 27 and/or by shutting the line by means of valve assembly 28, as shown for example in FIG. 1. In order to prevent deposits through particle agglomeration, sedimentation, gelification or similar and/or to remove these, using the described ink supply system 2 it is now possible to intermittently—i.e. pre-determinable or dependent on the flow speed and the volume of ink consumed—reverse the ink flow in the connection lines 19 and 21. These forms of deposits and contaminants can thus be kept in suspension or fixed deposits and adhesions and above all resistant deposits can be removed simply by the reversal of the flow direction of the ink, and helpfully also during an ongoing printing process. This reversal of the flow direction of the ink through the connection lines 19 and 21 can be achieved by adjusting the valve assembly 35 so that a greater negative pressure is generated in the supply tank 17 than in the return tank 22 and the ink is thus forced to flow from the return tank 22 to the supply tank 17.

It is also possible to plan an operating mode for example, in which the timeframe during which the ink flow is reversed and forced in the direction opposite to the standard direction is kept relatively short, so that any overheating in the print heads 7 can be avoided by supplying the ink from the return tank 22, which is comparatively less warm than that in the supply tank 17.

An improvement can be achieved if the conveyance means 16 and 25 are either designed for the reversible conveyance of the ink or parallel conveyance means are installed in order to be able to reverse the ink flow in the return line 24 and the filler line 15 at anytime.

Alternatively, it can also be advantageous if the circulation of the inks—as shown with the dotted lines—takes place directly between the supply tank 17 and the return tank 22. This assembly, also for printing operations in standard mode, has the advantage when used with scanner print heads, i.e. those that move intermittently back and forth diagonally to the feed direction of the printable object 4, that the moving masses can be minimised by the omission of the return line 24, which is otherwise required to move concurrently. In this instance it may also be advantageous to install a filter assembly 18 if necessary with a degassing unit 43 in the line between the return line 22 and the supply tank 17.

It is also possible to install an appropriate conveyance means 46 in this circulation line 44. The control of the negative pressure ratios in the supply and return tanks 17, 22 and the various conveyance means 16, 25 can be undertaken by the central controller 31, as per the known specifications. Via the controller 31 it is possible to appropriately control the means 32 using the active pressure controller 36 in order to guarantee the previously described pressure ratios in the supply and return tank 17, 22 and in the pressure heads 7, in particular in the output area 8. It is possible here to install pressure sensors 45, in place of or in addition to the regulation of the pressure in the vacuum module 32, also in the supply and/or return tank and/or in the flow channel.

FIG. 2. shows that it is possible, in between the previously described reversal of the ink flow, to achieve cleaning between the supply tank 17 and return tank 22 or alternatively exclusive a cleaning of the supply and return tanks 17 and 22 by reversing the conveyance of the ink from the return tank 22 into the supply tank 17, which is forced by the negative pressure.

Figure 3:
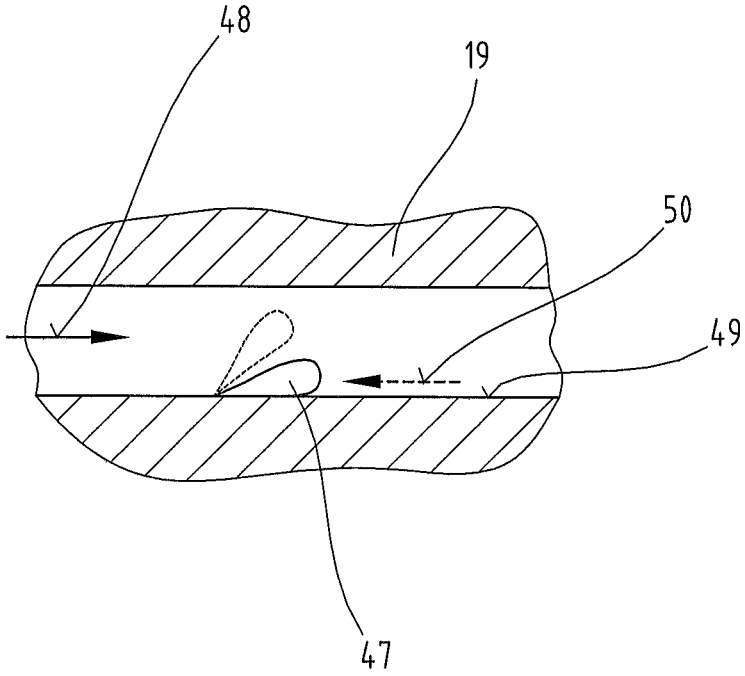
FIG. 3 shows a section of a flow channel with the schematic depiction of an impurity adhered to the channel wall, shown as a simplified schematic cutaway side view.

This can take place for example where the negative pressure in the supply tank 17 is increased by adjusting the valve assembly 35 to the position shown in FIG. 2 and thus drawing ink from the flow channels 20 of the individual print heads 7, the connection lines 19, 21 and the return tank 22. The ink excess in the supply tank 17 which results from this can be suctioned off by opening the valve assembly 28 and/or actuating the charging of the conveyance means 27 in the intermediate tank 12. This facilitates the return to the supply tank 17 or the intermediate tank 12, of any particle agglomeration, sedimentation, gelification or similar which has formed in the ink during the printing process as a result of physical/chemical processes, and which has adhered either to the inside of the connection lines or the tanks as schematically shown in FIG. 3, and which is more easily dislodged as a result of the counter-flows which take place in normal printing operations.

In this way, any deposits 47 or impurities which may otherwise lead to irrecoverable nozzle failures, are flushed out of the flow channels 20 of the pressure heads 7.

The parallel connection of print heads 7 and above all the parallel connection of each individual print head 7 with the supply tank and return tank 17, 22, has the advantage that the level of contamination and interruptions due to impurities can be considerably reduced because the ink only flows through a single flow channel 20 of a single print head 7. As shown with the setting of the valve assemblies 29 and 30 in FIG. 2, with this operating status the supply of fresh ink is inhibited by the filler line 15 or the take-off of ink from the return tank 22 via the return line 24.

Advantageous here is that the negative pressure in the supply tank 17 suctions the impurities from the flow channels 20 and is thus able to better and more gently remove a blockage in the fine nozzle channels than through pressure impacting with an overpressure.

This cleaning process or cleaning cycle can be reinforced after the interruption of the ink supply from the filler line 15 and the ink removal by the return line 24 through the application of the respective negative pressure in the return tank 22, by the entire ink supply being suctioned out of the supply tank 17 across the bottom of the tank and through the print heads 7 and perfused if necessary with a higher flow speed. If the supply tank 17 is then emptied, the negative pressure can be applied exclusively to the supply tank 17 via the means 32, for example by switching the valve assembly 35, or a greater pressure can be applied in the return tank 22 than in the supply tank 17.

This results in suctioning from the bottom of the return tank 22, through the connection lines 19, 21 and the flow channels 20 of the pressure heads 7 into the supply tank 17 and from here via the drainage line 25 into the intermediate tank 12.

The aforementioned impurities that accumulate during this cleaning process do not affect the further use of the ink because they mix with the fresh ink fed into the ink reservoir in the intermediate tank 12 and where applicable in the main tank 11 and the conveyance of the ink from the intermediate tank 12 runs via the filter assembly 18, in which these impurities are then ultimately separated and removed from the ink circuit.

FIG. 3 shows a purely schematic section of a channel such as the supply channel 13, the flow channel 20 or a line such as the filler line 15 and the connection line 19 or 21 as a cutaway side view. In this channel or line, a deposit 47 has adhered as a result of e.g. particle agglomeration, sedimentation, gelification or similar. It is now schematically illustrated that this deposit 47 is located on an internal wall 49 of the line 19 with the flow direction 48, which is present for example during standard printing mode. If the flow direction 48 is now reversed to flow direction 50, as shown with the slashed arrow, the deposit 47 is faced with extensive resistance from the flowing media and can be detached more easily from the internal wall 49 as shown with the slashed line, and more easily removed and flushed away from the internal wall 49 due not only to the flow but the counter resistance.

The cleaning effect can thus be additionally reinforced by the use of a counter-flow direction 50.

With the aforementioned ink supply system it is also necessary to heat the ink and regulate its temperature. For this purposes, it is possible that the ink may be preheated or warmed in the main tank 11. This could be carried out using electric heating element 51 installed in the main tank or temperature sensors 52. Controlling the heating element 51 whilst monitoring the temperature with the temperature sensors 52 can be carried out by means of the controller 31.

It is however essential that the ink in the intermediate tank 12 be controlled precisely and regulated by the heating elements 51 and the temperature sensors 52 and the ink must be maintained at the requisite temperature in the print heads 7. If necessary, it is also possible to slightly exceed this temperature so that, despite any cooling down in the transport lines from the intermediate tank 12 to the print heads 7, the ink can be fed to the supply tank 17 or the print heads 7 at the required temperature.

With a particularly advantageous development, the inventive ink supply system has been designed with two heating levels. In addition to the first heating level, namely the heating elements 51 in the intermediate tank 12, a heating element has also been installed in the supply tank 17 and the temperature in this supply tank 17 is monitored precisely by the temperature sensor. The heating elements 53 can be configured with a lower rating than the heating elements 51 in the intermediate tank 12 and it is thus possible, through the appropriate use of temperature sensors, to achieve very high levels of regulation precision within a temperature range of +/−0.2° C.

The regulation can take place as per intermediate tank 12, by means of the controller 31. With these two heating levels it is possible to guarantee very precisely maintaining the temperature of the ink in the print heads 7. This is particularly advantageous in achieving high quality print results because the temperature has such a great influence on the viscosity and the drip formation when discharging the ink at the print heads 7.

It is also possible for example to install heating elements 51 or 53 inside the return tank 22. These heating elements in the return tank 22 can be used to heat the ink to a higher temperature during the cleaning process, so that a greater degree of viscosity can be achieved. This benefits the flow characteristics of the ink during the cleaning process and the flushing out of impurities or the dislodging of sedimentation or agglomeration. It is also possible in this context, primarily when the ink is first pumped from the supply tank 17 into the return tank 22, although also prior to starting a cleaning process, to briefly increase the temperature of the ink using the heating elements 53, in order to be able to utilise the advantages of ink's greater viscosity when flushing the print heads 7 in the direction of the return tank 22. The example embodiments show possible design variants for the ink supply system 2, whereby it is noted at this point that the invention is not restricted exclusively to the design variants specifically described, but instead facilitates diverse consolidated combinations of the individual design variants, and that the possibilities of variation depend, due to the technical teaching protected by patent, on the ability of the professional in this technical area. All conceivable design variants that are possible through the combination of the individual details of the presented and described configuration variants are thus also protected by the scope of the patent.

As a matter of form, it is finally also noted that in order to facilitate an enhanced understanding of the design of the ink supply system and its component parts, these are illustrated in part not to scale and/or enlarged and/or reduced in size.

The fundamental function of the independent inventive solutions can be taken from the description.

| | |
|---|---|
| 1 | Inkjet printer |
| 2 | Ink supply system |
| 3 | Feed device |
| 4 | Object |
| 5 | Feed direction |
| 6 | Print head assembly |
| 7 | Print head |
| 8 | Nozzles |
| 9 | Print width |
| 10 | Print area width |
| 11 | Main tank |
| 12 | Intermediate tank |

-continued

| | |
|---|---|
| 13 | Supply channel |
| 14 | Conveyance means |
| 15 | Filler line |
| 16 | Conveyance means |
| 17 | Supply tank |
| 18 | Filer assembly |
| 19 | First connection line |
| 20 | Flow channel |
| 21 | Second connection line |
| 22 | Return tank |
| 23 | Suction line |
| 24 | Return line |
| 25 | Conveyance means |
| 26 | Drainage line |
| 27 | Conveyance means |
| 28 | Valve assembly |
| 29 | Valve assembly |
| 30 | Valve assembly |
| 31 | Controller |
| 32 | Means |
| 33 | Pressure connection |
| 34 | Pressure connection |
| 35 | Valve assembly |
| 36 | Active pressure controller |
| 37 | Sensor device |
| 38 | Sensor device |
| 39 | Sensor device |
| 40 | Fluid level |
| 41 | Fluid level |
| 42 | Degassing unit |
| 43 | Degassing unit |
| 44 | Circulation line |
| 45 | Pressure sensor |
| 46 | Conveyance means |
| 47 | Deposit |
| 48 | Flow direction |
| 49 | Internal wall |
| 50 | Flow direction |
| 51 | Heating element |
| 52 | Temperature sensor |
| 53 | Heating element |

What is claimed is:

1. Process for cleaning an ink supply system for an inkjet printer with a print head assembly, said inkjet printer comprising at least one print head with one or more nozzles for at least one color, in which the ink circulates from a supply tank to a return tank via the print head and back to the supply tank during printing, wherein the at least one print head is linked via a first connection line with the supply tank, which is connected with an intermediate tank via a filler line with a first interconnected conveyance device and filter assembly, and also via a second connection line with the return tank, and wherein a pressure differential between the pressure in the supply tank and the pressure in the return tank can be maintained by a pressure control device, said pressure control device controlling a flow of ink from the supply tank via at least one flow channel in the at least one print head to the return tank, wherein the return tank is linked with the intermediate tank via a return line, where applicable also with a second interconnected conveyance device, wherein the differential pressure between the pressure in the return tank and the pressure in the supply tank is intermittently changed by the pressure control device, such that the flow direction of the ink through the at least one print head is reversed intermittently and during an ongoing printing process for a predetermined period of time to achieve cleaning.

2. Process for cleaning an ink supply system as per claim 1, wherein the ink is pumped from the supply or return tank into the intermediate tank using a conveyance means.

3. Process for cleaning an ink supply system as per claim 1, wherein a vacuum is generated alternately in the return or supply tank or inside the return or supply tank, in order to transport the ink from the supply tank into the return tank and from the return tank into the supply tank via the print head.

4. Process for cleaning an ink supply system as per claim 1, wherein the ink fed from the intermediate tank to the supply tank is filtered, and wherein fresh ink is added from a main tank during printing or whilst cleaning the ink returned to the intermediate tank.

5. Process for cleaning an ink supply system as per claim 1, wherein the ink in the intermediate tank is pre-heated until close to the required process temperature during a first heating stage and thereafter heated to the precise printing temperature in the supply tank.

6. Process for cleaning an ink supply system as per claim 1, wherein the ink is held at the desired printing temperature within a tolerance range of +/−0.5° C. and preferably +/−0.2° C.

* * * * *